US005304033A

United States Patent [19]

Tang

[11] Patent Number: 5,304,033

[45] Date of Patent: Apr. 19, 1994

[54] ROTARY COMPRESSOR WITH STEPPED COVER CONTOUR

[75] Inventor: Peter Y. Tang, Torrance, Calif.

[73] Assignee: Allied-Signal Inc., Morristown, N.J.

[21] Appl. No.: 916,660

[22] Filed: Jul. 20, 1992

[51] Int. Cl.[5] ..... F04D 1/00

[52] U.S. Cl. ..... 415/206; 415/914; 416/189; 416/195

[58] Field of Search ..... 415/58.2, 58.3, 203, 415/206, 228, 414; 416/185, 189, 194, 195, 223 B

[56] References Cited

U.S. PATENT DOCUMENTS

| | | | |
|---|---|---|---|
| 996,859 | 7/1911 | Keller | 415/58.2 |
| 2,827,261 | 3/1958 | Parker et al. | 415/206 |
| 3,893,787 | 7/1975 | Jones . | |
| 3,984,193 | 10/1976 | Yu | 415/228 |
| 4,594,052 | 6/1986 | Niskanen | 416/185 |
| 4,743,161 | 5/1988 | Fisher et al. . | |

FOREIGN PATENT DOCUMENTS

| | | | |
|---|---|---|---|
| 0348674 | 1/1990 | European Pat. Off. . | |
| 204622 | 11/1908 | Fed. Rep. of Germany . | |
| 2303975 | 10/1976 | France | 415/206 |
| 0132499 | 10/1981 | Japan | 416/223 B |
| 1326776 | 7/1987 | U.S.S.R. | 415/58.2 |
| 761937 | 11/1956 | United Kingdom . | |
| 798480 | 7/1958 | United Kingdom . | |

OTHER PUBLICATIONS

Patent Abstracts of Japan Feb. 3, 1983 vol. 7, No. 95 (M-209)(1204) 21 Apr. 1983 & JP,A,58 18 600 (Mitsubishi).

*Primary Examiner*—Edward K. Look
*Assistant Examiner*—Christopher M. Verdier
*Attorney, Agent, or Firm*—Ken C. Decker; William N. Antonis

[57] ABSTRACT

A compressor assembly includes a housing, and a rotatable impeller within the housing which includes a hub and blades extending from the hub. A ring circumscribes the leading edge of the blades, and cooperates with a groove in the housing to define a clearance therebetween which is larger than the clearance between the connecting edge of the blades and a corresponding conforming portion of the housing. This permits free flow of gas around the ring to enhance the operating range of the compressor wheel. The ring also stiffens the blades, permitting the thickness of the hub to be reduced, thereby further enhancing the operating range of the compressor wheel.

2 Claims, 1 Drawing Sheet

ROTARY COMPRESSOR WITH STEPPED COVER CONTOUR

BACKGROUND OF THE INVENTION

This invention relates to a rotary compressor.

Rotary compressors include a rotatable impeller wheel mounted on a rotating shaft. The impeller wheel carries several blades, which are mounted on the hub of the wheel for rotation within a housing. By rotating the impeller wheel, gas, usually atmospheric air, is drawn in through an inlet of the housing and discharged through a diffuser into a volute passage which circumscribes the impeller wheel. The impeller wheel may be rotated, in the case of a turbocharger, by a turbine wheel, or may be rotated by direct mechanical drive in the case of a blower or a supercharger. The air is discharged from the volute to provide charge air to the induction manifolds of an internal combustion engine upon which the device is used. Such compressor wheels, however, are stable only across a relatively narrow operating range. Operation of the compressor wheel outside of this range, in what is commonly referred to as the surge or choke regions, results in dangerous instabilities.

Accordingly, it is desirable to extend the operating range of compressor wheels, while at the same time maintaining maximum aerodynamic efficiency. U.S. Pat. No. 4,743,161 discloses one known way to increase the operating range of a compressor wheel. The compressor wheel discussed in this patent provides ports or openings spaced circumferentially around the housing to permit bidirectional flow of gas into the region of the compressor wheel between the upstream and downstream edges of the compressor blades.

SUMMARY OF THE INVENTION

The present invention provides a circumferentially extending ring which circumscribes the leading edge of the compressor blades. The ring stiffens the blades, thereby permitting the hub area to be made smaller, thus improving choke margin. A slot in the housing circumscribes the ring, and defines a clearance between the bottom of the groove or slot and the ring which is larger than the clearance between over the ring, thereby providing the range enhancing features of the prior art without providing the aerodynamic disturbing apertures or openings in the housing wall.

These and other features of the present invention will become apparent from the following description, with reference to the accompanying drawing, in which:

DETAILED DESCRIPTION

Figure 1:
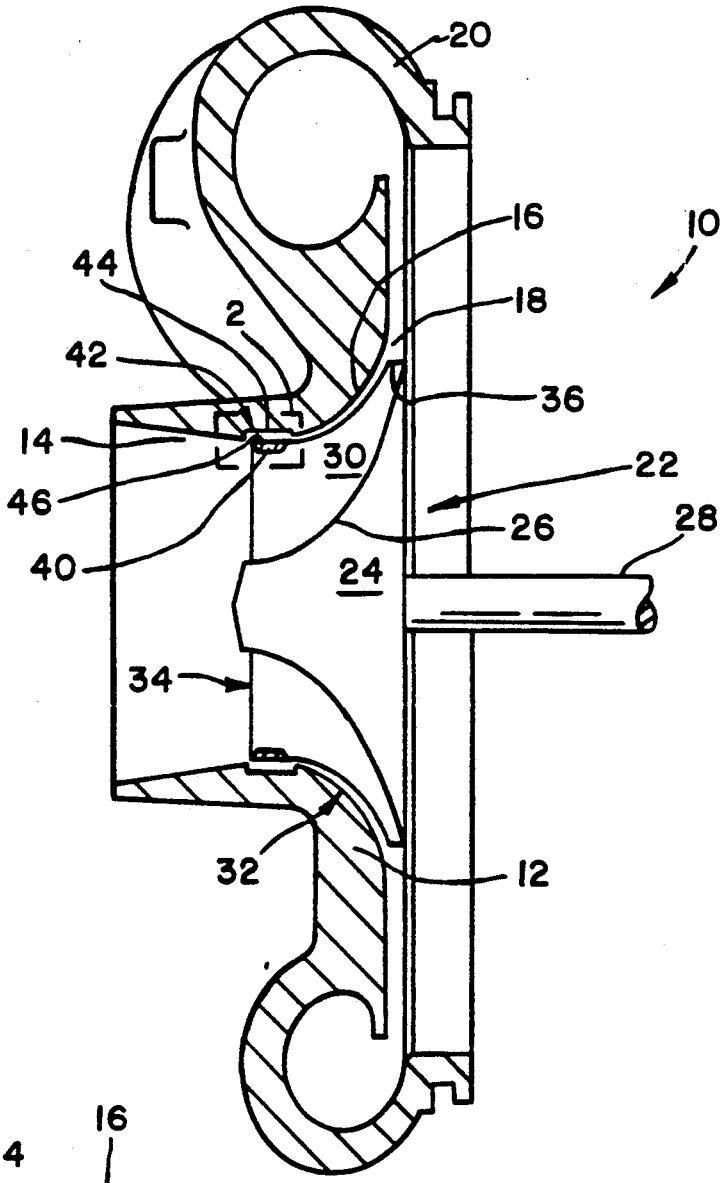
FIG. 1 is a cross-sectional view taken through the compressor assembly made pursuant to the teachings of the present invention.
Figure 2:
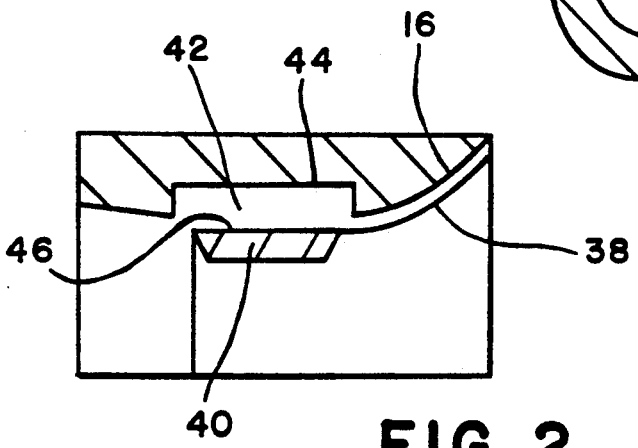
FIG. 2 is an enlargement of the circumscribed portion of FIG. 1.

Referring now to the drawings, a compressor assembly generally indicated by the numeral 10 includes a housing 12 defining a gas inlet area 14, a conforming wall portion 16, a diffuser area 18, and an outlet volute 20 which circumscribes a compressor wheel or impeller generally indicated by the numeral 22. The inlet opening 14, if the compressor assembly 10 is used to compress atmospheric air to provide charge air to a vehicle engine, is connected to ambient atmosphere through a conventional air cleaner (not shown). The compressed atmospheric air, after passing through the compressor wheel 22, is discharged into the volute 20, which is connected to the induction manifold of the internal combustion engine (not shown) for which the compressor assembly 10 is supplying charge air.

The compressor wheel 22 includes a contoured hub 24 having a curved, circumferentially extending outer surface 26. The compressor wheel 22 is mounted on a shaft 28. If the compressor assembly 10 is a part of an exhaust gas driven turbocharger, a turbine wheel (not shown) is mounted on the other end of the shaft 28, and rotates the shaft 28 in a manner well known to those skilled in the art. As is also well known to those skilled in the art, the shaft 28 may also be driven by mechanical devices, such as a drive belt.

A plurality of circumferentially spaced blades 30 project from the surface 26 of the hub 24. The blades 30 are complexly curved in three dimensions for maximum aerodynamic efficiency. Each of the blades 30 is defined by a free edge generally indicated by the numeral 32. The free edge 32 includes an inlet edge portion 34, against which gas entering the inlet opening 14 impacts, an exit edge portion 36, which faces the diffuser 18, a connecting edge portion 38 which and conforms generally to the conforming wall 16 of the housing 12 so that a clearance is defined therebetween.

A circumferentially extending ring 40 is secured to the free edge 32 of the blades 30 and extends axially (with respect to the axis rotation to the shaft 28) from the leading edge portion 34. To achieve maximum aerodynamic efficiency, the thickness of the ring 40, and the axial length of the ring 40, should be determined based on the blade design, while assuring that the ring 40 is sufficiently stiff to perform its stiffening function of the blades 30. The ring 40, if the wheel 22 is cast, is castable as a part of the cast wheel and then machined. A circumferentially extending groove 42 is provided in a portion of the conforming wall 16 of housing 12 that extends substantially coaxial with the axis rotation of the shaft 28. The groove 42 and the ring 40 have a lehgth extending parallel to the axis of rotation of the hub 24. The length of the groove 42 is sufficiently greater than that of the ring 40 to permit gas to flow around the ring through the second clearance. The depth of the groove 42 is such that the clearance between a circumferentially extending wall 44 of the groove 42 and the outer circumferential surface 46 is greater than the clearance between the edge of the blade and the wall. This permits flow of gas from the inlet 14 over the circumferentially extending surface 46 of the ring 40 and into the clearance defined between the connecting edge portion 38 of the blades 30 and the conforming portion 16 of the housing, during high flow rate operation, and from the clearance between the blades and the wall to the inlet during low flow rate operation. This bidirectional flow provides the range extending benefits of the prior art method of providing circumferentially spaced ports in the conforming wall portion 16. Because of the stiffening effect provided by the ring, the thickness of the hub 24 maybe reduced over that used in comparable compressor assembly 10.

I claim:

1. Compressor assembly comprising a housing, an impeller rotatably mounted in said housing, said impeller including a hub rotatable about an axis of rotation and blades extending from said hub, said blades having a free edge, said free edge having an inlet edge portion, an exit edge portion, and a connecting edge portion extending between the inlet edge portion and the exit edge portion, said housing including a conforming portion conforming generally to said connecting edge portion of said free edge and cooperating with the latter to define a first clearance therebetween, a ring circumscribing said free edge of said blades adjacent the inlet edge portion and rotatable with said blades relative to said housing, said conforming portion extending across said ring to define a flowpath around said ring communicating with said first clearance, said housing defining a circumferentially extending groove circumscribing said ring, said groove cooperating with said ring to define a second clearance therebetween, said second clearance being larger than said first clearance, wherein said groove and said ring have a length extending parallel to the axis of rotation of said hub, the length of said groove being sufficiently greater than said ring to permit gas to flow around said ring through said second clearance.

2. Compressor assembly as claimed in claim 1, wherein said groove has a depth projecting radially with respect to said axis of rotation, the depth of said groove defining at least a portion of said second clearance.

* * * * *